US006329333B1

(12) United States Patent
Merz et al.

(10) Patent No.: US 6,329,333 B1
(45) **Date of Patent: *Dec. 11, 2001**

(54) PASTELIKE DETERGENT AND CLEANING AGENT

(75) Inventors: Thomas Merz, Hilden; Khalil Shamayeli, Duesseldorf; Edgar Koeppelmann, Hilden, all of (DE)

(73) Assignee: Henkel-Ecolab GmbH & Co. OHG, Dusseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/355,404

(22) PCT Filed: Jan. 21, 1998

(86) PCT No.: PCT/EP98/00299

§ 371 Date: Oct. 18, 1999

§ 102(e) Date: Oct. 18, 1999

(87) PCT Pub. No.: WO98/33881

PCT Pub. Date: Aug. 6, 1998

(30) Foreign Application Priority Data

Jan. 30, 1997 (DE) ..... 197 03 364

(51) Int. Cl.[7] ..... C11D 1/72; C11D 1/83; C11D 17/08

(52) U.S. Cl. ..... 510/336; 510/300; 510/320; 510/340; 510/342; 510/351; 510/356; 510/360; 510/361; 510/404; 510/509; 510/511; 510/535; 510/536; 510/537

(58) Field of Search ..... 510/300, 320, 510/336, 340, 342, 351, 356, 360, 361, 509, 511, 535, 536, 537, 404

(56) References Cited

U.S. PATENT DOCUMENTS

| | | | | |
|---|---|---|---|---|
| 4,144,226 | | 3/1979 | Crutchfield et al. | 528/231 |
| 4,146,495 | | 3/1979 | Crutchfield et al. | 252/89 R |
| 4,702,857 | | 10/1987 | Gosselink | 252/174.23 |
| 4,861,512 | | 8/1989 | Gosselink | 252/174.23 |
| 4,889,644 | | 12/1989 | Amberg et al. | 252/8.9 |
| 4,929,380 | | 5/1990 | Schulz et al. | 252/121 |
| 5,114,611 | * | 5/1992 | Van Kralingen et al. | 252/186.33 |
| 5,221,488 | | 6/1993 | Amberg et al. | 252/8.9 |
| 5,266,233 | * | 11/1993 | Houghton et al. | 252/174.21 |
| 5,364,552 | * | 11/1994 | Merz et al. | 252/174.22 |
| 5,441,661 | * | 8/1995 | Beaujean et al. | 252/95 |
| 5,494,488 | | 2/1996 | Arnoldi et al. | 8/137 |
| 5,501,814 | | 3/1996 | Engelskirchen et al. | 252/174.17 |
| 5,518,645 | | 5/1996 | Beaujean et al. | 252/108 |
| 5,580,941 | | 12/1996 | Krause et al. | 527/300 |
| 5,765,724 | | 6/1998 | Amberg et al. | 222/1 |
| 5,783,616 | | 7/1998 | Krause et al. | 524/58 |
| 5,785,210 | | 7/1998 | Amberg et al. | 222/229 |
| 5,830,956 | | 11/1998 | Stockhausen et al. | 526/318.2 |
| 5,847,065 | | 12/1998 | Krause et al. | 527/300 |
| 5,854,191 | | 12/1998 | Krause et al. | 510/276 |
| 5,854,321 | | 12/1998 | Krause et al. | 524/58 |
| 5,880,080 | | 3/1999 | Amory et al. | 510/320 |
| 5,929,014 | * | 7/1999 | Beaujean et al. | 510/336 |
| 6,248,708 | * | 6/2001 | Merz et al. | 510/404 |

FOREIGN PATENT DOCUMENTS

| | | |
|---|---|---|
| 814 956 | 6/1969 | (CA) . |
| 958 618 | 12/1974 | (CA) . |
| 989 557 | 5/1976 | (CA) . |

(List continued on next page.)

OTHER PUBLICATIONS

Derwent Patent Abstract No. 88–362045/51.
Derwent Patent Abstract No. 92–324616/40.
Derwent Patent Abstract No. 97–342933/32.
Derwent Patent Abstract No. 95–131965/18.
Derwent Patent Abstract No. 93–386557/48.
Derwent Patent Abstract No. 88–007804/02.
Derwent Patent Abstract No. 93–152449/18.
Derwent Patent Abstract No. 94–035002/04.
Derwent Patent Abstract No. 94–235530/29.
Derwent Patent Abstract No. 94/280420/35.
Derwent Patent Abstract No. 96–000404/01.
Derwent Patent Abstract No. 74–75753V/44.
Derwent Patent Abstract No. 97–133790/13.
Derwent Patent Abstract No. 97–204334/19.
Derwent Patent Abstract No. 97–416938/39.
Derwent Patent Abstract No. 97–481969/45.
Derwent Patent Abstract No. 98–019669/03.
Derwent Patent Abstract No. 95–345499/45.
Derwent Patent Abstract No. 68–81679P/00.
Derwent Patent Abstract No. 72–50636T/32.
Derwent Patent Abstract No. 73–27499U/20.

(List continued on next page.)

*Primary Examiner*—Yogendra N. Gupta
*Assistant Examiner*—Brian P. Mruk
(74) *Attorney, Agent, or Firm*—Andrew D. Sorensen; Ecolab Inc.

(57) ABSTRACT

A paste-form detergent and process of making the detergent is presented. The detergent is composed of: 5 to 30 percent by weight of an ethoxylated alcohol of the formula $R^1$—$(OC_2H_4)_m$—OH where $R^1$ is an alkyl or alkenyl group containing 9 to 15 carbon atoms and the average degree of ethoxylation m is 1 to 8; 1 to 20 percent by weight of an ethoxylated alcohol of the formula $R^2$—$(OC_2H_4)_n$OH where $R^2$ is an alkyl or alkenyl group containing 12 to 22 carbon atoms and the average degree of ethoxylation n is 3 to 14, and n is greater than m by at least 1.0; 1 to 20 percent by weight of an alcohol or alkyl ether corresponding to the formula $R^3$—O—$R^4$ where $R^3$ is an alkyl or alkenyl group containing 6 to 22 carbon atoms and $R^4$ is hydrogen or an alkyl group containing 1 to 6 carbon atoms; 20 to 80 percent by weight of an alkalizing agent, and 0 to 15 percent by weight of an organic builder. The paste-form detergent is useful in institutional laundries and results in a reduced tendency to foam at the rinsing and pressing stage.

35 Claims, No Drawings

FOREIGN PATENT DOCUMENTS

| | | |
|---|---|---|
| 1 036 455 | 8/1978 | (CA) . |
| 1 281 031 | 3/1991 | (CA) . |
| 0 066 944 | 12/1982 | (EP) . |
| 0 185 427 | 6/1986 | (EP) . |
| 0 241 984 | 10/1987 | (EP) . |
| 0 392 592 | 10/1990 | (EP) . |
| 0 443 651 | 8/1991 | (EP) . |
| 0 458 397 | 11/1991 | (EP) . |
| 0 544 490 | 6/1993 | (EP) . |
| 0 549 271 | 6/1993 | (EP) . |
| 0 630 964 | 12/1994 | (EP) . |
| 0 693 550 | 1/1996 | (EP) . |
| WO91/02792 | 3/1991 | (WO) . |
| WO91/08171 | 6/1991 | (WO) . |
| WO92/21760 | 12/1992 | (WO) . |
| WO93/05134 | 3/1993 | (WO) . |
| WO93/07276 | 4/1993 | (WO) . |
| WO93/18140 | 9/1993 | (WO) . |
| WO93/24623 | 12/1993 | (WO) . |
| WO94/02618 | 2/1994 | (WO) . |
| WO94/23053 | 10/1994 | (WO) . |
| WO94/25579 | 11/1994 | (WO) . |
| WO94/25583 | 11/1994 | (WO) . |
| WO95/02044 | 1/1995 | (WO) . |
| WO95/05477 | 2/1995 | (WO) . |
| WO95/07350 | 3/1995 | (WO) . |
| WO95/10592 | 4/1995 | (WO) . |
| WO95/10615 | 4/1995 | (WO) . |
| WO95/20039 | 7/1995 | (WO) . |
| WO95/20663 | 8/1995 | (WO) . |
| WO95/23221 | 8/1995 | (WO) . |
| WO95/30010 | 11/1995 | (WO) . |
| WO95/30011 | 11/1995 | (WO) . |
| WO95/30743 | 11/1995 | (WO) . |
| WO95/37427 | 12/1995 | (WO) . |

OTHER PUBLICATIONS

Derwent Patent Abstract No. 86–163432/26.
Derwent Patent Abstract No. 87–293393/42.
Derwent Patent Abstract No. 95–374569/49.
Derwent Patent Abstract No. 95–359645/47.
Derwent Patent Abstract No. 90–052265/08.
Derwent Patent Abstract No. 95–131966/18.

* cited by examiner

PASTELIKE DETERGENT AND CLEANING AGENT

This application is filed under 35 U.S.C. 371 and based on PCT/EP98/00299, filed Jan. 21, 1998.

BACKGROUND OF THE INVENTION

1. Field of the Invention

This invention relates to paste-form detergents for use in institutional laundries and to a process for their production.

2. Discussion of Related Art

Detergents used in the home are adapted to domestic requirements. Thus, they are normally powders or are sufficiently liquid to lend themselves to problem-free pouring and dosing. Since liquid detergents are also expected to be stable in storage over relatively broad temperature ranges, organic solvents and/or hydrotropes are often added to them although they do not themselves make any contribution to the washing/cleaning result and, for this reason, are not wanted. One way of avoiding possible dosing problems with insufficiently liquid detergents is proposed in European patent application EP 253 151 A2. This document describes liquid and, in some cases, highly viscous detergents based on nonionic and anionic surfactants which contain polyethylene glycol as hydrotrope and which do not have to be dosed in liquid form by the user, but instead are packed in portions in bags of water-soluble material, for example polyvinyl alcohol.

The paste-form detergent described in European patent EP 295 525 B1 consists of a liquid phase of nonionic surfactant which is liquid at temperatures below 10° C. and—dispersed therein—a solid phase with a certain particle size consisting of washing alkalis, sequestering agents and optionally anionic surfactants. The surfactants or surfactant mixtures used must have a pour point (solidification point) below 5° C. to avoid solidification of the paste at low transportation and storage temperatures. This detergent paste is intended for institutional laundries and has such good flow properties that it can be pumped through a suction line by a conventional delivery pump. However, it has been found that pastes of the type in question are not always able satisfactorily to guarantee the homogeneity of their ingredients during the production process and often tend to separate, even in storage. This separation involves not only the separation of solid from liquid ingredients, but also phase separation of the liquid ingredients.

Another paste-form detergent which contains as nonionic surfactant from 40 to 70% by weight of ethoxylated $C_{10-20}$ fatty alcohol—liquid at room temperature—with an average degree of ethoxylation of 1 to 8, 20 to 50% by weight of ethoxylated and propoxylated $C_{10-20}$ fatty alcohols—liquid at room temperature—with an average degree of ethoxylation of 2 to 8 and an average degree of propoxylation of 1 to 6 and 1 to 10% by weight of soap is described in International patent application WO 95/09229. This paste-form detergent is so pseudoplastic that it does not flow under the effect of gravity at room temperature, but assumes a distinctly lower viscosity on shearing and then flows under the effect of gravity. This paste-form detergent is preferably dosed by shearing to reduce its viscosity and then dosing the flowable product using feed pumps.

In automatic batch washing machines in particular, detergents often lead to foaming problems which can have particularly unpleasant effects at the rinsing and pressing stages. The formation of foams at these stages would appear to be attributable to the presence of surfactants, more especially nonionic surfactants, which have accumulated on the washed laundry and which pass from the final rinse to the rinsing and pressing stages under high mechanical stressing. Besides the operational problems caused by excessive foaming, irritation of the skin through the presence of relatively large quantities of surfactant on the washed laundry cannot be completely ruled out.

In addition, demands to stop using detergent ingredients which have been found to lack sufficient biodegradability have also recently been raised in institutional laundries. These demands are particularly difficult to satisfy because the cleaning performance of the detergents used has to meet very much stricter requirements by comparison with the conditions prevailing in domestic washing. This applies in particular to the surface-active ingredients which make a key contribution to the cleaning result and among which synthetic anionic surfactants, particularly of the sulfonated alkyl benzene type, play a prominent role in this regard.

Accordingly, the problem addressed by the present invention was to provide a paste-form detergent for use in institutional laundries which would show a reduced tendency to foam at the rinsing and pressing stage and which would lead to smaller quantities of surfactant on the washed laundry and would also combine high stability in storage with high cleaning performance although it would be at least largely free from the synthetic anionic surfactants of the alkyl benzenesulfonate type normally required for this purpose.

Surprisingly, these problems have largely been solved by optimizing the nonionic surfactant component and by using long-chain alcohols and/or long-chain alkyl ethers.

DESCRIPTION OF THE INVENTION

The present invention relates to a paste-form detergent for use in institutional laundries containing nonionic surfactant, organic and/or inorganic builder, alkalizing agent and optionally bleaching agent, enzyme, redeposition-inhibiting polymer and/or other typical ingredients, characterized in that it contains 5% by weight to 30% by weight and, more particularly, 10% by weight to 25% by weight of an ethoxylated alcohol corresponding to general formula (I):

$$R^1—(OC_2H_4)_m—OH \quad (I)$$

in which $R^1$ is an alkyl or alkenyl group containing 9 to 15 carbon atoms, more particularly 12 to 14 carbon atoms, and the average degree of ethoxylation m can assume values of 1 to 8, 1% by weight to 20% by weight and, more particularly, 5% by weight to 15% by weight of an ethoxylated alcohol corresponding to general formula (II):

$$R^2—(OC_2H_4)_nOH \quad (II)$$

in which $R^2$ is an alkyl or alkenyl group containing 12 to 22 carbon atoms and the average degree of ethoxylation n can assume values of 3 to 14, with the proviso that n is greater than m by at least 1.0 and preferably by at least 2.0, 20% by weight to 80% by weight of alkalizing agent, 1% by weight to 20% by weight and, more particularly, 3% by weight to 15% by weight of medium-chain to long-chain alcohol or alkyl ether corresponding to general formula (III):

$$R^3—O—R^4 \quad (III)$$

in which $R^3$ is an alkyl or alkenyl group containing 6 to 22 carbon atoms and, more particularly, 8 to 22 carbon atoms and $R^4$ is hydrogen or an alkyl group containing 1 to 6 carbon atoms, and up to 15% by weight, preferably no more than 10% by weight, more preferably no more than 8% by weight and most preferably no more than 5% by weight of organic builder of the polymeric polycarboxylate type. Polymeric polycarboxylates in the context of the invention are understood to be polymerization products of unsaturated mono- and/or dicarboxylic acids which, apart from carboxyl groups, have no other functionalities.

In a preferred embodiment, the detergent according to the invention contains up to 20% by weight and, more particularly, up to 10% by weight of an alkoxylated alcohol corresponding to general formula (IV):

$$R^5—(OC_2H_4)_x—(OC_3H_6)_y—OH \quad (IV)$$

in which $R^5$ is an alkyl or alkenyl group containing 9 to 15 carbon atoms and, more particularly, 12 to 15 carbon atoms and the average degree of ethoxylation x can assume a value of 3 to 7 and the average degree of propoxylation y a value of 2 to 8, as a further surfactant component in addition to the nonionic surfactants mentioned above.

The liquid phase of the paste-form detergent according to the invention is essentially formed by the nonionic surfactants corresponding to formulae I and II, which have different carbon chain lengths and different degrees of alkoxylation, by the alcohols or ethers corresponding to formula III and optionally by the additional surfactants corresponding to formula IV. The viscosity of the detergent according to the invention can be adjusted by combining ethoxylated alcohols corresponding to formulae I and II. In the compounds corresponding to formulae I, II and IV, the substituents $R^1$, $R^2$ and $R^5$ may be linear or branched, for example methyl-branched in the 2-position, linear chains containing primary etherified alcohol functions being preferred. The nonionic surfactant corresponding to formula I preferably has a carbon chain length of 8 to 14 carbon atoms and, more particularly, 12 to 14 carbon atoms and an average degree of ethoxylation m of 1 to 8 and, more particularly, 1 to 5. The nonionic surfactant corresponding to formula II has a broader carbon chain length distribution towards longer chains with 12 to 22, preferably 12 to 18 and more preferably 16 to 18 carbon atoms and a higher average degree of ethoxylation n of 3 to 14 and, more particularly, 6 to 12. The ethoxylated alcohols corresponding to formula I and the ethoxylated alcohols corresponding to formula II are preferably present in ratios by weight of 2:1 to 1:1.8. The detergent according to the invention may contain other nonionic surfactants typically used in detergents such as, for example, alkyl polyglycosides and/or fatty acid polyhydroxyamides. However, the surfactant component is preferably free from alcohols which have only been propoxylated.

So far as the substituent $R^3$ is concerned, the foregoing definitions of the substituents $R^1$ and $R^2$ largely apply to the alcohols or ethers corresponding to general formula III which contribute towards the particularly favorable low-temperature stability of the detergents according to the invention, which are responsible for the substantial absence of foam and for the reduction in surfactant deposits on the washed laundry and which additionally contribute the washing performance. Besides hydrogen, $R^4$ is preferably a methyl, ethyl, propyl or butyl group, hydrogen and the methyl group, more especially hydrogen, being particularly preferred. In one preferred embodiment of the invention, the detergents contain up to 15% by weight and preferably from 2% by weight to 10% by weight of compounds corresponding to general formula III.

The detergent may optionally contain as further surfactants up to 25% by weight, preferably up to 7.5% by weight and, more preferably, from 0.5 to 3% by weight of synthetic anionic surfactants selected in particular from alkyl benzenesulfonates, alkyl or alkenyl sulfates and/or ether sulfates. Suitable synthetic anionic surfactants, which are preferably incorporated in the detergent according to the invention in solid, fine-particle and substantially water-free form, include in particular those of the sulfonate or sulfate type which are normally present as alkali metal salts and preferably as sodium salts. However, the above-mentioned surfactants of the sulfonate type in particular may also be used in the form of their free acids. Besides $C_{9-13}$ alkyl benzensulfonates, suitable anionic surfactants of the sulfonate type are linear alkane sulfonates containing 11 to 15 carbon atoms which are obtainable by sulfochlorination or sulfoxidation of alkanes and subsequent saponification or neutralization, salts of sulfofatty acids and esters thereof which are derived from saturated $C_{12-18}$ fatty acids sulfonated in particular in the $\alpha$-position and lower alcohols, such as methanol, ethanol and propanol, and olefin sulfonates which are formed, for example, by sulfonation of terminal $C_{12-18}$ olefins and subsequent alkaline hydrolysis. Suitable surfactants of the sulfate type are, in particular, primary alkyl sulfates with preferably linear alkyl chains containing 10 to 20 carbon atoms which have an alkali metal, ammonium or alkyl- or hydroxyalkyl-substituted ammonium ion as countercation. Derivatives of linear alcohols containing in particular 12 to 18 carbon atoms and branched-chain analogs thereof, so-called oxoalcohols, are particularly suitable. Accordingly, the sulfation products of primary fatty alcohols with linear dodecyl, tetradecyl or octadecyl groups and mixtures thereof are particularly suitable. Particularly preferred alkyl sulfates contain a tallow alkyl group, i.e. mixtures essentially containing hexadecyl and octadecyl groups. The alkyl sulfates may be prepared in known manner by reaction of the corresponding alcohol component with a typical sulfating agent, more particularly sulfur trioxide or chlorosulfonic acid, and subsequent neutralization with alkali metal, ammonium or alkyl- or hydroxyalkyl-substituted ammonium bases. In addition, the sulfated alkoxylation products of such alcohols, so-called ether sulfates, may be present in the detergents. Ether sulfates such as these preferably contain 2 to 30 and, more particularly, 4 to 10 ethylene glycol groups per molecule. In one particularly preferred embodiment of the invention, the detergent is completely free from synthetic anionic surfactants and at least free from synthetic anionic surfactants of the alkyl benzenesulfonate type. Naturally occurring anionic surfactants include in particular the soaps which are present in the detergents according to the invention in quantities of preferably up to 5% by weight and, more preferably, from 0.5% by weight to 2% by weight. Suitable soaps are, in particular, the alkali metal salts of saturated and/or unsaturated $C_{12-18}$ fatty acids, for example coconut oil fatty acid, palm kernel oil fatty acid or tallow fatty acid. It is particularly preferred to use salts of a carboxylic acid mixture of—based on the carboxylic acid mixture as a whole—2% by weight to 8% by weight of $C_{14}$ carboxylic acid, up to 1% by weight of $C_{15}$ carboxylic acid, 18% by weight to 24% by weight of $C_{16}$ carboxylic acid, up to 3% by weight of $C_{17}$ carboxylic acid, 20% by weight to 42% by weight of $C_{18}$ carboxylic acid and 30% by weight to 44% by weight of $C_{20-22}$ carboxylic acid.

The solid phase of the detergent according to the invention is essentially formed by the alkalizing agents and builders, although other particulate auxiliaries may optionally be present. The solid phase should be homogeneously dispersed in the liquid surfactant phase. The ingredients of the paste-form detergent present as solid phase should be fine-particle materials and should have a mean particle size of 5 $\mu$m to 200 $\mu$m, at most 15% of the particles being larger than 200 $\mu$m in size. It is surprisingly possible to incorporate relatively coarse-particle solids, for example those in which 20 to 50% of the particles are larger than 100 $\mu$m in size, in the paste-form detergents according to the invention without any disadvantages. The mean particle size of the particles forming the solid phase is preferably 10 $\mu$m to 80 $\mu$m and more preferably 10 $\mu$m to 60 $\mu$m, the maximum particle size being below 300 $\mu$m and, more particularly, below 250 $\mu$m. In a preferred embodiment, 90% by weight of the solid powder-form ingredients are smaller than 200 $\mu$m in size and, more particularly, smaller than 150 $\mu$m in size. The mean particle size may be determined by known methods (for example by laser diffraction or Coulter Counter).

The alkalizing agents present as an additional component are often also referred to as washing alkalis. They may largely be assigned to the solid phase. Under the conditions under which the detergents according to the invention are used, they provide for a pH value in the alkaline range which is normally from 9 to 13 and, more particularly, from 10 to 12 (as measured on a 1% by weight solution of the detergent in ion-exchanged water). The preferred alkalizing agent is amorphous alkali metal silicate, more particularly sodium metasilicate with an $Na_2O:SiO_2$ ratio of 1:0.8 to 1:3 and preferably 1:1 which is preferably used in water-free form. Besides the alkali metal silicate, water-free alkali metal carbonate or alkali metal hydrogen carbonate are also suitable, although this does require larger amounts of liquid phase on account of absorption processes and, accordingly, is less preferred. The detergents contain 20% by weight to 80% by weight, preferably 30% by weight to 70% by weight and more preferably 40% by weight to 60% by weight of alkalizing agent. The alkalizing agent component of the detergent according to the invention may consist solely of silicate. Alkali metal carbonate or alkali metal hydrogen carbonate is present in quantities of preferably not more than 40% by weight, more preferably up to 25% by weight and, in one preferred embodiment of the invention, in quantities below 10% by weight. If the presence of phosphate is ecologically acceptable in the use of the detergents according to the invention (for example where the wastewater is subjected to phosphate-eliminating treatment), polymeric alkali metal phosphates, such as sodium tripolyphosphate, may optionally be present in the paste-form detergents according to the invention. Their percentage content is preferably up to 70% by weight and more preferably from 15% by weight to 40% by weight, based on the detergent as a whole, the percentage content of other solids, for example the alkali metal silicate and/or alumosilicate optionally present, being reduced accordingly.

Suitable organic builders are, in particular, monomeric polycarboxylic acids and hydroxycarboxylic acids, such as citric acid or gluconic acid and salts thereof, and also those from the class of aminopolycarboxylic acids and polyphosphonic acids. Aminopolycarboxylic acids include nitrilotriacetic acid, ethylene diamine tetraacetic acid, diethylene triamine pentaacetic acid and higher homologs thereof, N,N-bis-(carboxymethyl)-aspartic acid preferably being used. Suitable polyphosphonic acids are 1-hydroxyethane-1,1-diphosphonic acid, aminotri(methylenephosphonic acid), ethylenediamine tetra(methylenephosphonic acid) and higher homologs thereof such as, for example, diethylene tetramine tetra(methylenephosphonic acid). The acids mentioned above are normally used in the form of their alkali metal salts, particularly their sodium and potassium salts. Other suitable builders include homopolymeric and/or copolymeric carboxylic acids and alkali metal salts thereof, the sodium or potassium salts again being particularly preferred. Builders of this type which have proved to be particularly suitable are polymeric carboxylates and polymeric carboxylic acids with a relative molecular weight of at least 350 in the form of their water-soluble salts, more particularly their sodium arid/or potassium salts, such as the oxidized polysaccharides according to International patent application WO 93/08251, polyacrylates, polymethacrylates, polymaleates and, in particular, copolymers of acrylic acid with maleic acid or maleic anhydride, preferably those of 50 to 70% acrylic acid and 50 to 10% maleic acid which are characterized, for example, in European patent EP 022 551. The relative molecular weight of the homopolymers is generally between 1,000 and 100,000 while the relative molecular weight of the copolymers is between 2,000 and 200,000 and preferably between 50,000 and 120,000, based on free acid. A particularly preferred acrylic acid/maleic acid copolymer has a relative molecular weight of 50,000 to 100,000. Suitable but less preferred compounds of this class are copolymers of acrylic acid or methacrylic acid with vinyl ethers, such as vinyl methyl ethers, vinyl esters, ethylene, propylene and styrene, in which the acid makes up at least 50% by weight. Other suitable water-soluble organic builders are terpolymers which contain two unsaturated acids and/or salts thereof as monomers and vinyl alcohol and/or an esterified vinyl alcohol or a carbohydrate as the third monomer. The first acidic monomer or its salt is derived from a monoethylenically unsaturated $C_{3-8}$ carboxylic acid and preferably from a $C_{3-4}$ monocarboxylic acid, more especially (meth)acrylic acid. The second acidic monomer or its salt may be derivative of a $C_{4-8}$ dicarboxylic acid, maleic acid being particularly preferred, and/or a derivative of an allyl sulfonic acid substituted in the 2-position by an alkyl or aryl group. Polymers such as these may be produced in particular by the methods described in German patent DE 42 21 381 and German patent application DE 43 00 772 and generally have a relative molecular weight of 1,000 to 200,000. Other preferred copolymers are those described in German patent applications DE 43 03 320 and DE 44 17 734 which preferably contain acrolein and acrylic acid/acrylic acid salts or vinyl acetate as monomers. The polyacetal carboxylic acids described, for example, in U.S. Pat. Nos. 4,144,226 and 4,146,495 which are obtained by polymerization of esters of glycolic acid, introduction of stable terminal groups and saponification to the sodium or potassium salts are also suitable, as are polymeric acids obtained by polymerization of acrolein and Canizzaro disproportionation of the polymer with strong alkalis. They are essentially made of acrylic acid units and vinyl alcohol units or acrolein units.

If such substances are present at all in the paste-form detergents according to the invention, the percentage content of organic carboxy-functional builders in the paste-form detergent according to the invention may be up to 10% by weight and is preferably from 1% by weight to 7.5% by weight and more preferably from 2% by weight to less than 5% by weight, the percentage content of polymeric polycarboxylate being as small as possible and, in a preferred embodiment of the invention, being less than 5% by weight. The substances in question are also used in water-free form. The percentage content of other organic polymers, for example polyvinyl pyrrolidone, is preferably also small and, more preferably, in the range from 0.5% by weight to 1% by weight. In another preferred embodiment of the invention, the percentage content of polymeric polycarboxylate and other organic polymers together is less than 5% by weight.

Besides the phosphate mentioned above, inorganic builders suitable for use in the detergents according to the invention are crystalline alkali metal silicates and fine-particle alkali metal alumosilicates, more particularly zeolites of the NaA, X and/or P type. Suitable zeolites normally have a calcium binding capacity of 100 to 200 mg CaO/g which may be determined in accordance with DE 24 12 837. Their particle size is normally in the range from 1 $\mu$m to 10 $\mu$m. They are used in dry form. In the present case, the water present in combined form in the zeolites is not problematical. Preferred crystalline silicates, which may be present either on their own or together with the alumosilicates mentioned, are crystalline layer silicates with the formula $NaMSi_xO_{2+x}.yH_2O$, where m is hydrogen or sodium, x is a number of 1.9 to 4 and y is a number of 0 to 20. Preferred values for x are 2, 3 and 4. Crystalline layer silicates such as these are described, for example, in European patent application EP 163 514. Both β- and δ-sodium disilicates $Na_2Si_2O_5.yH_2O$ are particularly preferred, β-sodium disilicate being obtainable, for example, by the process described in International patent application WO 91/08171. Suitable crystalline silicates are commercially available under the names of SKS-6 (manufacturer: Hoechst) and Nabion® 15 (manufacturer: Rhone-Poulenc). The content of inorganic builder in the paste may be up to 35% by weight and is preferably up to 25% by weight and, more preferably, between 10% by weight and 25% by weight.

In one preferred embodiment, the detergents according to the invention contain 5% by weight to 25% by weight and, more particularly, 10% by weight to 20% by weight of builders, the quantity of polymeric polycarboxylates being no more than 10% by weight and preferably no more than 7% by weight and the quantity of phosphonates being no more than 2% by weight and preferably no more than 1% by weight.

In addition, the paste-form detergent according to the invention may contain an oxygen-containing oxidizing agent and, optionally, a bleach activator. The oxidizing agents used are, in particular, inorganic peroxygen compounds, sodium perborate tetrahydrate and, sodium perborate monohydrate being particularly important alongside sodium percarbonate. Other suitable oxidizing agents are, for example, persulfates, peroxypyrophosphates, citrate perhydrates and $H_2O_2$-yielding peracidic salts or peracids, such as perbenzoates, peroxophthalates, diperoxyazelaic acid or diperoxydodecanedioic acid. Sodium percarbonate, sodium persulfate and/or sodium perborate monohydrate are preferably used. Oxidizing agents may be present in the detergents according to the invention in quantities of preferably up to 25% by weight and, more preferably, between 10% by weight and 20% by weight.

The oxidizing power of such oxidizing agents can be improved by using bleach activators which form peroxocarboxylic acids under perhydrolysis conditions. There are numerous proposals in the literature for such bleach activators, above all from the classes of N- and O-acyl compounds, for example polyacylated alkylenediamines, more particularly tetraacetyl ethylenediamine, acylated glycolurils, more particularly tetraacetyl glycoluril, N-acylated hydantoins, hydrazides, triazoles, hydrotriazines, urazoles, diketopiperazines, sulfuryl amides and cyanurates, carboxylic anhydrides, more particularly phthalic anhydride, carboxylic acid esters, more particularly sodium nonanoyloxybenzenesulfonate, sodium isononanoyloxybenzenesulfonate and triacetin (glycerol triacetate), and acylated sugar derivatives, such as pentaacetyl glucose. A bleach activator which forms peracetic acid under the washing conditions is preferably used, tetraacetyl ethylenediamine being particularly preferred. Detergents according to the invention preferably contain up to 10% by weight and, more preferably, 3% by weight to 8% by weight of bleach activator. The bleaching effect of aqueous peroxide liquors can be increased by the addition of bleach activators to such an extent that the effects obtained at temperatures as low as 60° C. are largely the same as those achieved with the peroxide liquor alone at 95° C. An increase in bleaching performance can be obtained, particularly at even lower temperatures, by using transition metal salts and complexes, as proposed for example in European patent application EP 0 392 592, EP 0 443 651, EP 0 458 397, EP 0 544 490, EP 0 549 271, EP 0 630 964 or EP 0 693 550, as so-called bleach catalysts in addition to or instead of the conventional bleach activators. The transition metal complexes known as bleach-activating catalysts from German patent applications DE 195 29 905, DE 195 36 082, DE 196 05 688, DE 196 20 411 and DE 196 20 267 are also particularly suitable. Bleach-activating transition metal complexes, more particularly with the central atoms Mn, Fe, Co, Cu, Mo, V, Ti and/or Ru, are present in detergents according to the invention in quantities of preferably not more than 1% by weight and, more preferably, from 0.0025% by weight to 0.25% by weight.

In addition, a detergent according to the invention may contain other washing aids which are normally present in quantities of up to about 15% by weight, based on the detergent as a whole. Examples of such washing aids include enzymes, redeposition inhibitors, soil release agents, dye transfer inhibitors, such as homopolymers and/or copolymers of vinyl pyrrolidone and/or vinyl imidazole, optical brighteners, other foam regulators and/or dyes and fragrances. Where fragrances which are generally liquid are present, they blend into with the liquid phase of detergents according to the invention. By virtue of the small quantities in which they are used, however, they have no significant influence on the flow behavior of the pastes.

The paste-form detergents according to the invention are preferably substantially free from water. By "substantially free from water" is meant a state in which the content of free water, i.e. water which is not present in the form of water of hydration and water of constitution, is below 3% by weight, preferably below 2% by weight and more preferably below 1% by weight. Higher water contents are a disadvantage because they disproportionately increase the viscosity of the detergent and, in particular, reduce its stability. Organic solvents, which include the low molecular weight and low-boiling alcohols and ether alcohols normally used in liquid concentrates, and hydrotropic compounds may optionally be present in quantities of up to 6% by weight, but are preferably absent.

Enzymes optionally present in the detergents according to the invention include, in particular, enzymes from the class of proteases, lipases, cutinases, amylases, pullulanases, xylanases, hemicellulases, cellulases, peroxidases and oxidases and mixtures thereof, the use of protease, amylase, lipase and/or cellulase being particularly preferred. The percentage content of enzymes is preferably from 0.2% by weight to 1.5% by weight and more preferably from 0.5% by weight to 1% by weight. The enzymes may be adsorbed onto supports and/or embedded in shell-forming substances in the usual way or may be incorporated in the paste as concentrated water-free liquid formulations. Suitable proteases are known, for example, from International patent applications WO 91/02792, WO 92/21760, WO 93/05134, WO 93/07276, WO 931/8140, WO 93/24623, WO 94/02618, WO 94/23053, WO 94/25579, WO 94/25583, WO 95/02044, WO 95/05477, WO 95/07350, WO 95/10592, WO 95/10615, WO 95/20039, WO 95/20663, WO 95/23211, WO 95/27049, WO 95/3001 0, WO 95/30011, WO 95/30743 and WO 95/34627. Enzymes stabilized against oxidative damage, for example the proteases and amylases known under the commercial names of Durazym® or Purafect®OxP and Duramyl® or Purafect®OxAm, are preferably used.

Suitable redeposition inhibitors and soil release agents are cellulose ethers, such as carboxymethyl cellulose, methyl cellulose, hydroxyalkyl celluloses and cellulose mixed ethers, such as methyl hydroxyethyl cellulose, methyl hydroxypropyl cellulose and methyl carboxymethyl cellulose. Sodium carboxymethyl cellulose and mixtures thereof with methyl cellulose are preferably used. The soil release agents normally used include copolyesters containing dicarboxylic acid units, alkylene glycol units and polyalkylene units. Soil-release copolyesters of the type mentioned and their use in detergents have been known for some time. For example, DE-OS 16 17 141 describes a washing process using polyethylene terephthalate and/or polyoxyethylene glycol copolymers. DE-OS 22 00 911 relates to detergents containing nonionic surfactant and a copolymer of polyoxyethylene glycol and polyethylene terephthalate. DE-OS 22 53 063 mentions acidic textile finishes containing a copolymer of a tribasic carboxylic acid and an alkylene or cycloalkylene polyglycol and optionally an alkylene or cycloalkylene glycol. European patent EP 0 066 944 relates to textile treatment compositions containing a copolyester of ethylene glycol, polyethylene glycol, aromatic dicarboxylic acid and sulfonated aromatic dicarboxylic acid in certain molar ratios. Methyl- or ethyl-end-capped polyesters containing ethylene and/or propylene terephthalate and polyethylene oxide terephthalate units and detergents containing such a soil-release polymer are known from European patent EP 185 427. European patent EP 241 984 relates to a polyester containing substituted ethylene units and glycerol units in addition to oxyethylene groups and terephthalic acid units. The percentage content of redeposition inhibitors and/or soil-release agents in detergents according to the invention is generally not more than 2% by weight and is preferably between 0.5% by weight and 1.5% by weight. In one preferred embodiment of the invention, the detergent is free from such agents.

The dye transfer inhibitors suitable for use in detergents according to the invention include in particular polyvinyl pyrrolidones, polyvinyl imidazoles, polymeric N-oxides, such as poly-(vinylpyridine-N-oxide), and copolymers of vinyl pyrrolidone and vinyl imidazole and mixtures thereof. The percentage content of dye transfer inhibitors in detergents according to the invention is preferably between 0.1% by weight and 2% by weight and more preferably between 0.2% by weight and 1% by weight. In one preferred embodiment of the invention, the detergent is free from dye transfer inhibitors.

The detergents according to the invention may contain, for example, derivatives of diaminostilbene disulfonic acid and alkali metal salts thereof as optical brighteners, more particularly for textiles of cellulose fibers (for example cotton). Suitable optical brighteners are, for example, salts of 4,4'-bis-(2-anilino-4-morpholino-1,3,5-triazin-6-yl-amino)-stilbene-2,2'-disulfonic acid or compounds of similar structure which contain a diethanolamino group, a methylamino group or a 2-methoxyethylamino group instead of the morpholino group. In addition, brighteners of the optically substituted dibenzofuranyl biphenyl type or the optionally substituted 4,4'-distyryl diphenyl type, for example 4,4'-bis-(4-chloro-3-sulfostyryl)-diphenyl, may also be present. Mixtures of brighteners may also be used. Brighteners of the 1,3-diaryl-2-pyrazolone type, for example 1-(p-sulfamoylphenyl)-3-(p-chlorophenyl-2-pyrazoline and compounds of similar structure are particularly suitable for polyamide fibers. The percentage content of optical brighteners (or mixtures of optical brighteners) in the detergent according to the invention is generally not more than 1% by weight and is preferably from 0.05% by weight to 0.5% by weight. In a preferred embodiment of the invention, the detergent is free from optical brighteners.

Typical foam regulators which may be used in the detergents according to the invention in addition to the foam-regulating compounds of general formula III are, for example, mixtures of polysiloxane and silica, the fine-particle silica present therein preferably being silanized. The polysiloxanes may consist both of linear compounds and of crosslinked polysiloxane resins and mixtures thereof. Other foam inhibitors are paraffin hydrocarbons, more particularly microparaffins and paraffin waxes with melting points above 40° C., saturated fatty acids or soaps containing in particular 20 to 22 carbon atoms, for example sodium behenate, and alkali metal salts of phosphoric acid monoesters and/or dialkyl esters in which the alkyl chains contain 12 to 22 carbon atoms. Of these foam inhibitors, sodium monoalkyl phosphate and/or dialkyl phosphate containing $C_{16-18}$ alkyl groups are preferably used. The percentage content of foam regulators is preferably between 0.2% by weight and 2% by weight. In many cases, there is no need at all for the additional use of foam inhibitors.

In order to increase the physical stability and the chemical stability of—in particular—the bleaching component and enzymes optionally present, dehydrating agents, for example in the form of salts which bind water of crystallization, such as water-free sodium acetate, calcium sulfate, calcium chloride, sodium hydroxide, magnesium silicate, or metal oxides, such as CaO, MgO, $P_4O_{10}$ or $Al_2O_3$, may also be used. Dehydrating agents such as these, with which the water content of detergents according to the invention can be reduced to particularly low values, are present in the detergents according to the invention in quantities of preferably 1% by weight to 10% by weight and, more preferably, 2% by weight to 8% by weight.

Paste-form detergents according to the invention are preferably produced by initally introducing the nonionic surfactants of formulae I and II and optionally IV, adding the alcohol or ether corresponding to formula III and optionally mixing the whole with more foam regulator, soap or the basic fatty acid, polymeric polycarboxylate or other organic polymer, synthetic anionic surfactant and optical brightener to form a homogeneous compound. A compound such as this is largely stable in storage and flowable at temperatures in the range from room temperature to 40° C., even if the ingredients of the compound are not always completely liquid or dissolved at those temperatures. The mixture of the remaining solid ingredients of the paste-form detergent is added to the compound thus formed, preferably after heating to temperatures of 40° C. to 120° C. and, more particularly, in the range from 60° C. to 90° C. and are dispersed in the compound, more particularly by stirring. When addition of the powder is terminated, the temperature should not be below 60° C. The mixture thus obtained is then preferably subjected to wet grinding which gives the product the required consistency and homogeneity. Other ingredients, more particularly temperature-sensitive or shearing-sensitive ingredients, such as perfume oils and enzymes, are then added and should be uniformly incorporated as carefully as possible in order not to destroy the structure of the paste. Immediately after their production, the detergents according to the invention are flowable and pumpable under the effect of shear forces and can thus be packed in conventional supply containers.

A paste-form detergent according to the invention has a viscosity at 25° C. of 80,000 mPa·s to 250,000 mPa·s and, more particularly, in the range from 100,000 mPa·s to 250,000 mPa·s, as measured with a Brookfield rotational viscosimeter (spindle No. 7) at 5 revolutions per minutes. Under otherwise the same conditions, the viscosity at 50 revolutions per minute is preferably in the range from 20,000 mPa·s to 80,000 mPa·s. These viscosity figures are read off after a measuring time of 3 minutes in order to allow for any thixotropic effect the paste may have. In one particular embodiment of the invention, the paste-form detergent preferably has such a viscosity at room temperature that it does not flow under the effect of gravity. It is then particularly pseudoplastic, i.e. it has a distinctly lower viscosity on shearing and flows under the effect of gravity. In a particularly preferred embodiment, the paste has a viscosity of 3,000 mPa·s to 12,000 mPa·s at 25° C. and at a shear rate of 0.01 $s^{-1}$, as measured with a Bohlin CS rheometer (manufacturer: Bohlin) with a plate/plate measuring system, plate interval 0.5 to 4 mm. On exposure to adequate shear forces, for example a shear rate of $10^{-1}$ for otherwise the same measuring conditions, a detergent according to the invention preferably has a considerably lower viscosity—generally 100 to 1,000 times lower. The reduction in viscosity on shearing is largely reversible, i.e. on removal of the shear forces, the detergent returns to its original physical state without separating. It is important in this connection to bear in mind the fact that the viscosities mentioned are not measured immediately after production of the paste, but instead are the viscosities of stored pastes so to speak in equilibrium because the shear forces acting in the course of the production process lead to a lower paste viscosity which only gradually increases to the critical viscosity. Storage times of one month are generally sufficient for this purpose.

A detergent according to the invention normally has a density of 1.3 kg/l to 1.6 kg/l. The detergent according to the invention can be dosed using conventional paste dispensers, as described for example in International patent application WO 95/29282, German patent application DE 196 05 906, German patent DE 44 30 418 and European patents EP 0 295 525 and EP 0 356 707. A dispenser particularly suitable for dosing pseudoplastic paste-form detergents is known, for example, from International patent application WO 95/09263 and is preferably used for dosing pseudoplastic pastes according to the invention. The detergents according to the invention may optionally be packed in portions in films, particularly water-soluble films. Such films are described, for example, in European patent application EP 253 151.

EXAMPLES

Some Examples of the composition of detergents according to the invention are given in Tables 1 and 2 below. The paste-form detergents showed very good stability in storage and had an excellent cleaning performance, even in the absence of synthetic anionic surfactant.

TABLE 1

| | Composition of paste-form detergents (% by weight) | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Nonionic surfactant I[a)] | 18 | 18 | 18 | 11 | 12.5 | 12.5 | 12.5 | 12.5 | 12.5 | 12.5 | 12.5 | 6.5 |
| Nonionic surfactant II[b)] | 11 | 11 | 11 | 18 | — | — | — | — | — | — | — | — |
| Nonionic surfactant II[c)] | — | — | — | — | 10 | 10 | 10 | 10 | 10 | 10 | — | — |
| Nonionic surfactant II[d)] | — | — | — | — | — | — | — | — | — | — | 10 | 10 |
| Nonionic surfactant IV[e)] | — | — | — | — | — | — | — | — | — | — | — | 6 |
| Alkyl benzenesulfonate | — | — | — | — | 2.5 | 2.5 | 2.5 | 2.5 | 2.5 | 2.5 | 2.5 | 2.5 |
| Soap[f)] | 1 | 1 | 1 | 1 | — | — | — | — | — | — | — | — |
| PVP[g)] | — | — | — | — | — | — | — | — | — | — | 1 | 1 |

TABLE 1-continued

| | Composition of paste-form detergents (% by weight) | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Isotridecanol | 5 | 5 | 5 | 5 | 4 | — | 4 | 4 | — | — | 5 | 5 |
| Dodecanol | — | — | — | — | — | 4 | — | — | 4 | — | — | — |
| Builder I[h)] | 5 | 5 | 5 | 5 | 5.5 | 5.5 | 5.5 | 5.5 | 5.5 | 5.5 | 5.5 | 5.5 |
| Builder II[i)] | 0.2 | 0.2 | 0.2 | 0.2 | 1.5 | 1.5 | 1.5 | 1.5 | 1.5 | 1.5 | 1.5 | 1.5 |
| NTA | — | — | — | — | 4 | 4 | 4 | 4 | 4 | 4 | 4 | 4 |
| Na metasilicate | 47 | 57 | — | — | 53 | 53 | 53 | 33 | 33 | 20 | 47 | 47 |
| Na tripolyphosphate | 20 | — | 20 | 20 | — | — | — | — | 20 | 20 | — | — |
| Na percarbonate | — | — | 20 | 20 | — | — | — | — | — | — | — | — |
| TAED | — | — | 4 | 4 | — | — | — | — | — | — | — | — |
| Enzyme | — | — | 1 | 1 | — | — | — | — | — | — | — | — |
| CMC/MC[k)] | 1 | 1 | 1 | 1 | 1 | 1 | 1 | 1 | 1 | 1 | 1 | 1 |
| Foam inhibitor[l)] | 1 | 1 | 1 | 1 | — | — | — | — | — | — | — | — |
| Foam inhibitor[m)] | — | — | — | — | 1 | 1 | 1 | 1 | 1 | 1 | 1 | 1 |
| Optical brightener[n)] | — | — | — | — | 0.3 | 0.3 | 0.3 | 0.3 | 0.3 | 0.3 | 0.3 | 0.3 |
| Na carbonate | to 100 | | | | | | | | | | | |

[a)] $C_{12-14}$ fatty alcohol + 3 EO (Dehydol ® LS 3, a product of Henkel KGaA)
[b)] $C_{12-18}$ fatty alcohol + 5 EO (Dehydol ® LT 5, a product of Henkel KGaA)
[c)] $C_{12-18}$ fatty alcohol + 8 EO (Genapol ® T080, a product of Hoechst AG)
[d)] 1:1 mixture of saturated and unsaturated $C_{16-18}$ fatty alcohols containing 5 EO and 10 EO (a product of Henkel KGaA)
[e)] $C_{12-14}$ fatty alcohol + 4 EO + 5 PO (Dehypon ® LS 54, a product of Henkel KGaA)
[f)] $C_{16-22}$ fatty acid Na salt (Edenor ® HT 35, a product of Henkel KGaA)
[g)] Polyvinyl pyrrolidone (Sokalan ® HP 50, a product of BASF AG)
[h)] Polymeric polycarboxylate (Sokalan ® CP 5, a product of BASF AG)
[i)] Disodium hydroxyethane diphosphonate (Turpinal ® 2 NZ, a product of Henkel KGaA)
[k)] Carboxymethyl cellulose/methyl cellulose mixture (2.5:1)
[l)] Mono-/distearyl phosphate
[m)] Paraffin/silicone foam regulator
[n)] Tinopal ® PLC, a product of Ciba Geigy AG

TABLE 2

| | Composition of paste-form detergents (% by weight) | | | | | | |
|---|---|---|---|---|---|---|---|
| | 13 | 14 | 15 | 16 | 17 | 18 | 19 |
| Nonionic surfactant I[a)] | 14 | 14 | 15 | 15 | 7 | 6 | 8 |
| Nonionic surfactant II[b)] | 8 | 8 | — | — | — | — | — |
| Nonionic surfactant II[c)] | — | — | 7 | 7 | 7 | — | — |
| Nonionic surfactant II[d)] | — | — | — | — | — | 8 | 8 |
| Nonionic surfactant IV[e)] | — | — | — | — | 8 | 8 | 6 |
| Alkyl benzenesulfonate | — | — | 2.5 | 2.5 | 2.5 | 2.5 | 2.5 |
| Soap[f)] | 1 | 1 | — | — | — | — | — |
| PVP[g)] | — | — | — | — | — | — | 1 |
| Isotridecanol | 5 | 5 | — | — | 5 | — | 5 |
| Dodecanol | — | — | 5 | 5 | — | 5 | — |
| Builder I[h)] | 5 | 5 | 5.5 | 5.5 | 5.5 | 5.5 | 5.5 |
| Builder II[i)] | 0.2 | 0.2 | 1.5 | 1.5 | 1.5 | 1.5 | 1.5 |
| NTA | — | — | 4 | 4 | 4 | 4 | 4 |
| Na metasilicate | 45 | 48 | 45 | 45 | 45 | 20 | 44 |
| Na tripolyphosphate | 20 | — | — | — | — | 20 | — |
| CMC/MC[k)] | 1 | 1 | 1 | 1 | 1 | 1 | 1 |
| Foam inhibitor[l)] | 1 | 1 | — | — | — | — | — |
| Foam inhibitor[m)] | — | — | 1 | 1 | 1 | 1 | 1 |
| Optical brightener[n)] | — | — | 0.3 | 0.3 | 0.3 | 0.3 | 0.3 |
| Na carbonate | to 100 | | | | | | |

[a)] $C_{12-14}$ fatty alcohol + 3 EO (Dehydol ® LS 3, a product of Henkel KGaA)
[b)] $C_{12-18}$ fatty alcohol + 5 EO (Dehydol ® LT 5, a product of Henkel KGaA)
[c)] $C_{12-18}$ fatty alcohol + 8 EO (Genapol ® T080, a product of Hoechst AG)
[d)] 1:1 mixture of saturated and unsaturated $C_{16-18}$ fatty alcohols containing 5 EO and 10 EO (a product of Henkel KGaA)
[e)] $C_{12-14}$ fatty alcohol + 4 EO + 5 PO (Dehypon ® LS 54, a product of Henkel KGaA)
[f)] $C_{16-22}$ fatty acid Na salt (Edenor ® HT 35, a product of Henkel KGaA)
[g)] Polyvinyl pyrrolidone (Sokalan ® HP 50, a product of BASF AG)
[h)] Polymeric polycarboxylate (Solkalan ® CP 5, a product of BASF AG)
[i)] Disodium hydroxyethane diphosphonate (Turpinal ® 2 NZ, a product of Henkel KGaA)
[k)] Carboxymethyl cellulose/methyl cellulose mixture (2.5:1)

TABLE 2-continued

| | Composition of paste-form detergents (% by weight) | | | | | | |
|---|---|---|---|---|---|---|---|
| | 13 | 14 | 15 | 16 | 17 | 18 | 19 |

[l)] Mono-/distearyl phosphate
[m)] Paraffin/silicone foam regulator
[n)] Tinopal ® PLC, a product of Ciba Geigy AG

What is claimed is:

1. A paste-form detergent comprising:

(a) 5 to 30 percent by weight of an ethoxylated alcohol of formula (I):

$$R^1—(OC_2H_4)_m—OH \quad (I)$$

wherein $R^1$ is an alkyl or alkenyl group containing 9 to 15 carbon atoms and the average degree of ethoxylation m is 1 to 8;

(b) 1 to 20 percent by weight of an ethoxylated alcohol of formula (II):

$$R^2—(OC_2H_4)_nOH \quad (II)$$

wherein $R^2$ is an alkyl or alkenyl group containing 12 to 22 carbon atoms and the average degree of ethoxylation n is 3 to 14, and n is greater than m of Formula I by at least 1.0;

(c) 1 to 20 percent by weight of an alcohol or alkyl ether corresponding to general formula (III):

$$R^3—O—R^4 \quad (III)$$

wherein $R^3$ is an alkyl or alkenyl group containing 6 to 22 carbon atoms and $R^4$ is hydrogen or an alkyl group containing 1 to 6 carbon atoms;

(d) 20 to 80 percent by weight of an alkalizing agent; and (e) 0 to 15 percent by weight of an organic builder.

2. The detergent of claim 1, comprising 10 to 25 percent by weight of the ethoxylated alcohol of formula I.

3. The detergent of claim 1 comprising 5 to 15 percent by weight of the ethoxylated alcohol of formula II.

4. The detergent of claim 1 wherein $R^2$ of formula II is an alkyl or alkenyl group containing 16 to 18 carbon atoms.

5. The detergent of claim 1 wherein the weight ratio of the ethoxylated alcohol of formula I to the ethoxylated alcohol of formula II is 2:1 to 1:1.8.

6. The detergent of claim 1 wherein the average degree of ethoxylation n of the ethoxylated alcohol of formula II is at least 2.0 greater than the average degree of ethoxylation m of the ethoxylated alcohol of formula I.

7. The detergent of claim 1 comprising 3 to 15 percent by weight of the alcohol or alkyl ether of formula III.

8. The detergent of claim 1 further comprising up to 20 percent by weight of an alkoxylated alcohol of formula IV:

$$R^5—(OC_2H_4)_x—(OC_3H_6)_y—OH \quad (IV)$$

wherein $R^5$ is an alkyl or alkenyl group containing 9 to 15 carbon atoms and the average degree of ethoxylation x is 3 to 7 and the average degree of propoxylation y is 2 to 8.

9. The detergent of claim comprising up to 10% by weight of the alkoxylated alcohol of formula IV.

10. The detergent of claim 1 further comprising up to 5 percent by weight of soap.

11. The detergent of claim 1 further comprising 0.5 to 1 percent by weight of polyvinyl pyrrolidone.

12. The detergent of claim 10 comprising 0.5 to 2 percent by weight of the soap.

13. The detergent of claim 1 further comprising up to 25 percent by weight of a synthetic anionic surfactant selected from the group consisting of alkyl benzenesulfonates, alkyl or alkenyl sulfates and ether sulfates.

14. The detergent of claim 13 comprising 0.5 to 3 percent by weight of a synthetic anionic surfactant.

15. The detergent of claim 1 comprising 30 to 70 percent by weight of the alkalizing agent.

16. The detergent of claim 15 comprising 40 to 60 percent by weight of the alkalizing agent.

17. The detergent of claim 1 comprising 5 to 25 percent by weight of builders.

18. The detergent of claim 17 comprising 10 to 20 percent by weight of builders.

19. The detergent of claim 1 comprising a solid phase and a liquid phase wherein the solid phase is present as fine-particle materials having a mean particle size of 5 microns to 200 microns.

20. The detergent of claim 19 wherein the fine-particle materials have a mean particle size of 10 microns to 80 microns.

21. The detergent of claim 19 wherein less than 15 percent of the solids particles have a particle size of more than 200 microns.

22. The detergent of claim 1 wherein 20 to 50 percent by weight of the solid particles have a particle size of from 100 to 300 microns.

23. The detergent of claim 1 further comprising 0.2 to 1.5 percent by weight of an enzyme.

24. The detergent of claim 23 comprising 0.5 to 1 percent by weight of an enzyme.

25. The detergent of claim 23 comprising protease, amylase, lipase or cellulase, or mixtures thereof.

26. The detergent of claim 1 further comprising 1 to 10 percent by of a dehydrating agent.

27. The detergent of claim 26 further comprising 2 to 8 percent by of a dehydrating agent.

28. The detergent of claim 1 having a 25° C. Broookfield viscosity of 80,000 mPa·s to 250,000 mpa·s as measured at 5 revolutions per minute, and a 25° C. viscosity of 20,000 mPa·s to 80,000 mPa·s as measured at 50 revolutions per minute.

29. The detergent of claim 1 having a 25° C. Broookfield viscosity 20,000 mPa·s to 80,000 mPa·s as measured at 50 revolutions per minute.

30. The detergent of claim 1 comprising a paste substantially free from water.

31. The detergent of claim 1 wherein the organic builder comprises a polymeric polycarboxylate.

32. A process for producing a paste-form detergent comprising:

(a) combining:

(1) 5 to 30 percent by weight based on the detergent of an ethoxylated alcohol of formula (I):

$$R^1—(OC_2H_4)_m—OH \quad (I)$$

wherein $R^1$ is an alkyl or alkenyl group containing 9 to 15 carbon atoms and the average degree of ethoxylation m is 1 to 8; and (2) 1 to 20 percent by weight of an ethoxylated alcohol of formula (II):

$$R^2—(OC_2H_4)_nOH \quad (II)$$

wherein $R^2$ is an alkyl or alkenyl group containing 12 to 22 carbon atoms and the average degree of ethoxylation n is 3 to 14, and n is greater than m of Formula I by at least 1.0;

(b) adding 1 to 20 percent by weight of an alcohol or alkyl ether corresponding to general formula (III):

$$R^3—O—R^4 \quad (III)$$

wherein $R^3$ is an alkyl or alkenyl group containing 6 to 22 carbon atoms and $R^4$ is hydrogen or an alkyl group containing 1 to 6 carbon atoms;

to form a homogeneous surfactant mixture storage stable and flowable at temperatures from room temperature to 40° C.; and (c) dispersing in said homogeneous mixture at temperatures from 40° C. to 120° C.:

(1) 20 to 80 percent by weight of an alkalizing agent; and (2) 0 to 25 percent by weight of a builder.

33. The process of claim 31 further comprising combining with the ethoxylated alcohols (a) and (b) an alkoxylated alcohol of formula (IV):

$$R^5—(OC_2H_4)_x—(OC_3H_6)_y—OH \quad (IV)$$

wherein $R^5$ is an alkyl or alkenyl group containing 9 to 15 carbon atoms and the average degree of ethoxylation is 3 to 7 and the average degree of propoxylation y is 2 to 8.

34. The process of claim 31 wherein the alkylizing agent and builder are dispersed in the homogeneous surfactant mixture at a temperature of from 60° C. to 90° C.

35. The process of claim 31 further comprising wet grinding the paste form detergent.

* * * * *